US005877735A

United States Patent [19]

King et al.

[11] Patent Number: 5,877,735

[45] Date of Patent: Mar. 2, 1999

[54] SUBSTRATE CARRIERS FOR ELECTROLUMINESCENT DISPLAYS

[75] Inventors: Christopher N. King, Portland; Iranpour Khormaei, Beaverton; Brad Aitchison, Portland; Monte Rhoads, Hillsboro, all of Oreg.

[73] Assignee: Planar Systems, Inc., Beaverton, Oreg.

[21] Appl. No.: 494,184

[22] Filed: Jun. 23, 1995

[51] Int. Cl.[6] ..... G09G 3/30

[52] U.S. Cl. ..... 345/76; 345/204; 345/211; 313/506; 315/169.3

[58] Field of Search ..... 315/169.3, 169.1; 313/506, 509; 345/36, 76–82, 204, 205, 206, 211, 212; 340/825.81

[56] References Cited

U.S. PATENT DOCUMENTS

| | | | |
|---|---|---|---|
| 3,479,646 | 11/1969 | Requa | 345/81 |
| 4,733,228 | 3/1988 | Flegal | 340/719 |
| 4,823,121 | 4/1989 | Sakamoto et al. | 345/211 |
| 4,862,153 | 8/1989 | Nakatani et al. | 345/80 |
| 4,975,691 | 12/1990 | Lee | 345/79 |
| 5,202,675 | 4/1993 | Tokimoto et al. | 345/82 |
| 5,302,966 | 4/1994 | Stewart | 345/76 |
| 5,432,015 | 7/1995 | Wu et al. | 313/509 |
| 5,463,279 | 10/1995 | Khormaei | 315/169.3 |
| 5,473,222 | 12/1995 | Thoeny et al. | 315/169.3 |

OTHER PUBLICATIONS 16.4: TFEL Character Module Using a Multilayer Ceramic Substrate by Keiji Nunamura, Yoshio Sano and Kazuaki Utsumi, NEC Corporation, Kanagawa, Japan, SID 87 Digest pp. 299–302.

32.2: Charge Modulation Gray–Scale Method with Profiled Current Pulses for ACTFEL Displays by M.H. Aberg, VTT Technical Research Centre of Finland, Semiconductor Laboratory, Espoo, Finland, SID 93 Digest, pp. 765–768.

"19.5: Electrical Characterization and Modeling of ZnS:Mn ACTFEL Devices with Various Pulse Waveforms" by A.A. Douglas, J.F. Wager, Oregon State University, Corvallis, OR, SID 92 Digest, pp. 356–359.

"16–Level Gray–Scale Driver Architecture and Full–Color Driving for TFT–LCD" by K. Takahara, T. Yamaguchi, M. Oda, H. Yamaguchi, M. Okabe, Fujitsu Limited, Atsugi, Japan, 1991 IEEE, pp. 115–118.

"11.3: High–Resolution Active–Matrix Electroluminescent Display" by R. Khormael, S. Thayer, K. Ping, C. King, Planar Systems, Beaverton, OR; G. Dolny, A. Ipri, F L. Hsueh, R. Stewart, David Sarnoff Research Center, Princeton, NJ; T. Keyser, G. Becker, D. Kagey, Allied Signal Aerospace Corp., Columbia, MD; and M. Spitzer, Kopin Corp., Taunton, MA; SID 94 Digest, p. 137, 3 pages.

"A 6×6–in 20–lpi Electroluminescent Display Panel" by T.P. Brody, F.C. Luo, Z.P. Szepesi, and D.H. Davies, Westinghouse Research Laboratories, Pittsburgh, PA, IEEE Transactions on Electron Devices, vol. Ed–22, No. 9, Sep. 1975, pp. 739–748.

(List continued on next page.)

*Primary Examiner*—Lun-Yi Lao

*Attorney, Agent, or Firm*—Chernoff, Vilhauer, McClung & Stenzel, LLP

[57] ABSTRACT

An active matrix electroluminescent device that includes a plurality of layers. A rearwardly disposed support layer supports the plurality of layers and an interface circuit. The interface circuit is electrically connected to row and column drivers by a plurality of first electrical lines. The drivers are electrically connected to the plurality of layers so as to enable pixels within the electroluminescent device to be selected. An interface controller is remotely located from the support layer and is electrically connected to the interface circuit by at least one second electrical line so as to indicate which pixels within the device to illuminate. The number of first electrical lines is greater than the number of the at least one second electrical line. In another embodiment of the present invention, the number of lines required to interconnect a passive thin film electroluminescent device with an interface controller can in a similar manner be reduced by including an interface circuit.

18 Claims, 7 Drawing Sheets

OTHER PUBLICATIONS

"Thin–Film Transistor Switching of Thin–Film Electroluminescent Display Elements" by L.K. Kun, F.C. Luo, and J. Murphy, Westinghouse Research and Development Center, Pittsburgh, PA, pp. 236–242, reprinted from Proc. SID, vol. 21, 1980, pp. 85–91.

ACTA Polytechnica Scandinavica, Electrical Engineering Series No. 74, "An Electroluminescent Display Simulation System and its Application for Developing Grey Scale Driving Methods" by Markku Aberg, Helsinki 1993.

High–Voltage TFT Fabricated in Recrystallized Polycrystalline Silicon by T. Unagami and L. Dogure, IEEE Transactions on Electron Devices, vol. 35, No. 3, Mar. 1988.

19.2 Late–News Paper: The Fabrication of TFEL Displays Driven by a–Si TFTs by T. Suzuki, Y. Uno, J. Sakurai, Y. Sato, S. Kyozuka, N. Hiji, T. Ozawa, Fuji Xerox Co., Lt., Kanagawa, Japan, SID 92 Digest, pp. 344–347.

"MOS–EL Integrated Display Device" by K. Oki, Y. Ohkawa, K. Takahara and S. Miura, Fujitsu Laboratories, Ltd., Kobe, Japan, pp. 245–246, reprinted from SID Dig. 1982, pp. 266–267.

"37.1: A 31–in.–Diagnol Full–Color Surface–Discharge ac Plasma Display Panel" by S. Kanagu, Y. Kanazawa, T. Shinoda, K. Yoshikawa, T. Nanto, Fukitsu Ltd., Akashi City, Japan, SID 92 Digest, 4 pages.

Evaluation of a 64×64 CdSe TFT Addressed ACTFEL Display Demonstrator by J. Vanfleteren, J. Capon, J. De Baets, I. De Rycke, H. De Smet, J. Dourtreloigne, A. Van Calster, P. DeVisschere, Laboratory of Electronics, University of Gent, Belgium; and R. Sallmen, R. Graeffe, Planar International, Espoo, Finland, 1991 IEEE, pp. 134–136.

4.6: High–Performance Column Driver for Gray–Scale TFEL Displays, S.A. Teiner, H.Y. Tsoi, Supertex, Inc., Sunnyvale, CA, SID 88 Digest, pp. 31–34.

SUBSTRATE CARRIERS FOR ELECTROLUMINESCENT DISPLAYS

BACKGROUND OF THE INVENTION

The present invention relates to an improved thin-film electroluminescent device with increased reliability, safety and which may be used in a confined space.

The vast majority of computer displays are designed for placement on a desk or affixed to a portable computer, and accordingly have a rather large viewing area and associated housing for the placement of electronics therein. The construction of such displays, and in particular passive thin film electroluminescent displays (TFEL), have not been primarily concerned with designing the display for use in a much more confined space such as a head-mounted display.

TFEL displays are generally constructed with an electroluminescent phosphor layer sandwiched between dielectric layers, all three layers thereof located between a transparent front electrode layer and a rear electrode layer (all of which is described in greater detail in the detailed description of the preferred embodiment). Referring to FIG. 1, the rear electrode layer of the display 306 has a plurality of individual rear electrodes, each of which is electrically connected to a separate wire or line within an interconnect 300. Likewise, the front electrode layer has a plurality of individual front electrodes, each of which is electrically connected to a separate wire or line within an interconnect 302. Collectively, the wires in the interconnects 300 and 302 extending from the front electrodes and rear electrodes are typically routed with a plurality of elastomer interconnects. An elastomer interconnect is a relatively thin strip of parallel wires enclosed within a plastic casing. The interconnects are routed and electrically connected to a circuit board 304 at a distant location from the display 306. Such interconnects tend to have reliability problems transmitting signals over distances greater than ½ inch, due in part to the large number of wires or lines. The circuit board 304 includes row drivers 308 and column drivers 310 to illuminate selected pixels within the display 306. An interface controller 312 includes a frame buffer and timing controller to control the column drivers 310 and row drivers 308 through a set of lines 309 and 311. A data source 314, such as a general purpose computer, provides data representative of the desired image on the display 306 to the interface controller 312. An EL drive 316 provides a high voltage signal that is transmitted to the display 306, generally by the row drivers 308, for the illumination of selected pixels. The transmission of high voltage signals near a person's body, such as from the person's belt to his head, may present safety problems from prolonged exposure. The display 306, interconnects 300 and 302, and circuit board 304 may be enclosed within a single rather bulky housing. However, when such a display is used in an environment with limited available space, such as in a hand-held cellular telephone, head mounted display, or other device, the interconnects 300 and 302, and the circuit board 304 may require more space than is available. Further, locating the display 306, interconnects 300 and 302, and circuit board 304 within a restrictive space may necessitate an awkward and possibly expensive package. For example, an active matrix TFEL display with 1280 row electrodes and 1024 column electrodes would require over 2000 lines within an interconnect or plurality of interconnects, either of which requires substantial space and expense. Additionally, such a large number of lines decreases the reliability of transmitting signals.

Active matrix thin film electroluminescent displays (AMEL display or device) are frequently rather small, such as 1.3"×1.2". AMEL displays could be used in a wide range of applications, such as head mounted displays. The front of a head mounted display typically includes two separate displays, each of which is mounted on the headset for viewing by a respective eye of the wearer. An AMEL device typically includes a transparent electrode, a rear circuit layer that includes both row and column electrodes, and an interdisposed sandwich structure of a dielectric, phosphor, and dielectric (all of which is described in greater detail in the detailed description of the preferred embodiment). The main functional differences between an AMEL and a passive TFEL display are that each pixel in an AMEL display has its own switch to turn it on and off, and pixels in an AMEL display could be on nearly 100% of the time while pixels are on only a fraction of the time in passive TFEL displays. If an AMEL display wire is interconnected to the row drivers, column drivers, and other electrodes in a manner similar to passive TFEL devices, a separate wire would be required for each of the row and column electrodes in the rear circuit layer. The wires would have to be routed in the form of one or more elastomer interconnects to a circuit board. Accordingly, an AMEL display that has 1280 row electrodes and 1024 column electrodes would require over 2000 wires to transmit signals from the circuit board to the display, preferably in one or more elastomer interconnects. The circuit board would be located on a wearer's belt in a head-mounted display application. The physical size of the interconnects, presents a problem when routed from a wearer's head to his belt. The major problem is that the interconnects are large, bulky and heavy. Bulky and heavy head-mounted displays are less desirable and less comfortable for users. Interconnects with a large number of wires may be difficult to route from the front of the headset to the remotely located circuit board, add unnecessary expense, decrease the reliability of signal transmission, add unnecessary weight, and are prone to damage.

Referring to FIG. 2, an AMEL display is fabricated on a substrate 320, typically made of silicon. By providing a substrate 320 that is slightly larger than the display area 328, row drivers 322 and column drivers 324 may be fabricated on the substrate 320. Locating the row and column drivers 322 and 324 on the substrate 320 eliminates the need for the row and column drivers to be located on the circuit board 330. A plurality of bus lines 332 are fabricated on the outer portion of the substrate 320 to transmit signals from one location of the display to another. The display, as shown in FIG. 2, reduces the number of lines or wires required from the interface controller 326 to the display to approximately 100 lines or wires, depending upon the number of pixels in the device. Although significantly reduced from thousands, one hundred wires still requires a large interconnect. Transmitting high voltage and high frequency signals in the bus lines 332 near the display area 328 causes interference to the electronics in the row drivers 322 and column drivers 324. Also, the bus lines 332 require a substantial amount of substrate area to fabricate. Locating the bus lines 332 further from the row and column drivers 322 and 324, respectively, requires more substrate area, which in turn increases the size and expense of the display. In an attempt to decrease the amount of substrate 320 required the bus lines 332 may be made thin and placed closer together but this reduces the conductivity of the bus lines 328 and creates significant coupling between bus lines 332. Further, the choice of metals that can be deposited on a silicon substrate is limited, and those metals that are suitable have less conductivity than more desirable conductors such as gold and copper. In an attempt to compensate for the less conductive metals, wider lines are necessary to obtain desirable conductivity. However, wider lines require more substrate area.

In addition, a safety concern arises from the transmission of high voltage signals near the body of the wearer from an EL drive to the row drivers in a passive TFEL display and to the transparent electrode layer in an AMEL display. If the insulator on the wire is cut, or otherwise damaged, then the wearer could be receive a high voltage shock. Additionally, electromagnetic interference (EMI) from the high voltage wire may cause erroneous data in nearby data lines.

What would be desirable, therefore, is a display that eliminates the aforementioned drawbacks associated with the interconnects and permits the display, including the driving circuitry, to be packaged within a more limited space. Additionally, the size of the substrate should be minimized to reduce the cost of the device while allowing a greater diversity of more conductive metals to be selected for the bus lines. The high voltage lines routed to the display should be eliminated to alleviate safety concerns.

SUMMARY OF THE PRESENT INVENTION

The present invention overcomes the aforementioned drawbacks of the prior art by providing an active matrix electroluminescent device that includes a plurality of layers. A rearwardly disposed support layer supports the plurality of layers and an interface circuit. The interface circuit is electrically connected to row and column drivers by a plurality of first electrical lines. The drivers are electrically connected to the plurality of layers so as to enable pixels within the electroluminescent device to be selected. An interface controller is remotely located from the support layer and is electrically connected to the interface circuit by at least one second electrical line. The number of first electrical lines is greater than the number of the at least one second electrical line. In another embodiment, the number of lines required to interconnect a passive thin film electroluminescent device with an interface controller can similarly be reduced by including an interface circuit.

By locating the interface circuit on the same support layer as the plurality of layers a significant reduction in the number of lines required from the interface controller to the display is realizable. This reduction in the number of lines increases the reliability of the device while decreasing the size and weight of the interconnecting lines. Preferably, the interface controller transmits digital data to the interface circuit by encoding the digital data prior to transmission. The interface circuit receives and decodes the digital data for use by the display. The encoding and decoding circuits are preferably parallel-to-serial and serial-to-parallel circuits. Alternatively, any suitable signals may be transmitted between the interface controller and the interface circuit.

Another aspect of the present invention is the fabrication of bus lines directly on the support layer supporting the active matrix electroluminescent display. By fabricating the bus lines directly on the support layer, highly conductive metals may be selected for the bus lines which may be economically spaced a sufficient distance from both the display area and each other thereby reducing the electromagnetic interference effects of high voltage and high frequency signals transmitted in the bus lines.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
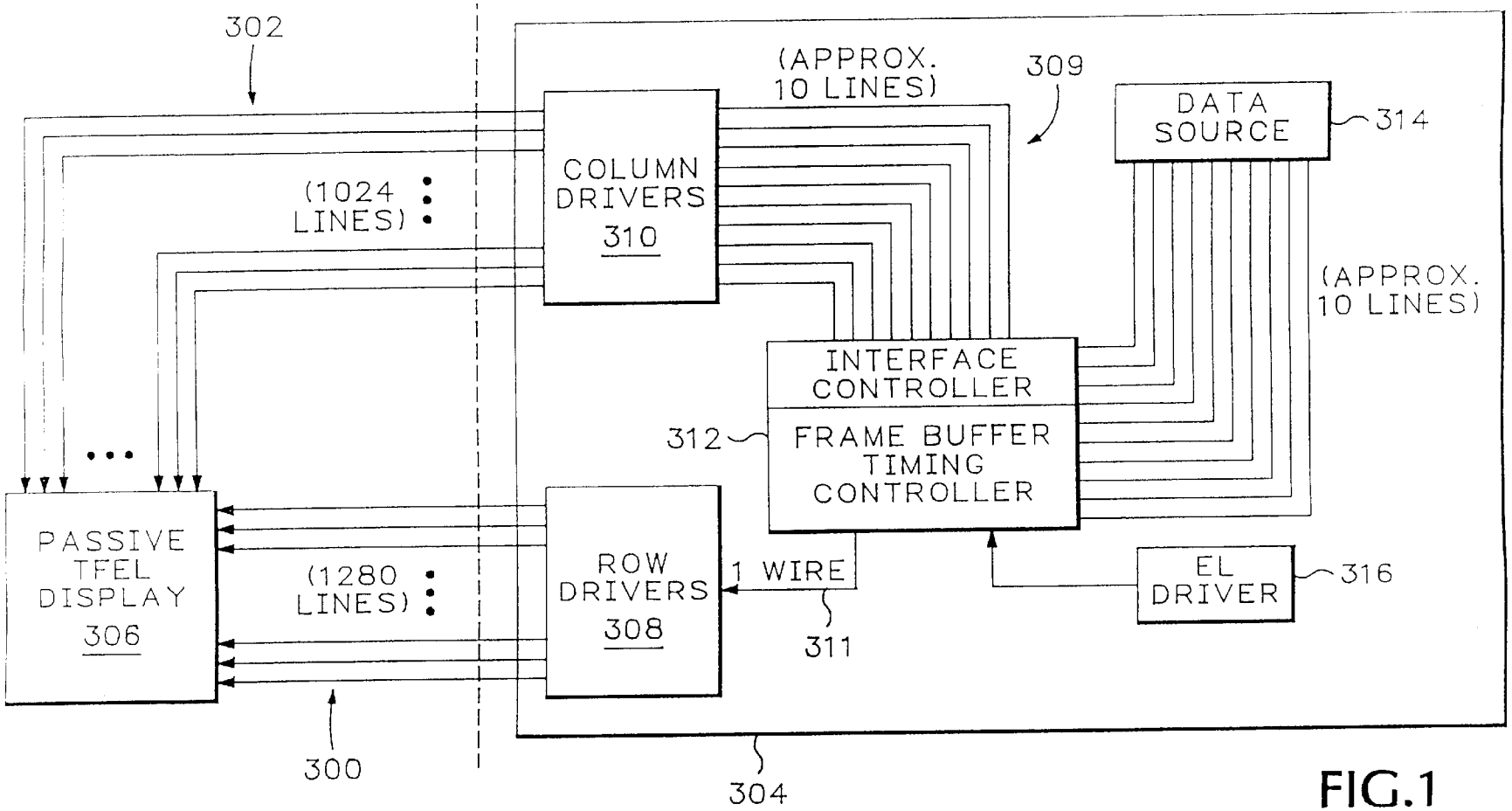
FIG. 1 is an electrical schematic of a passive thin film electroluminescent device.
Figure 2:
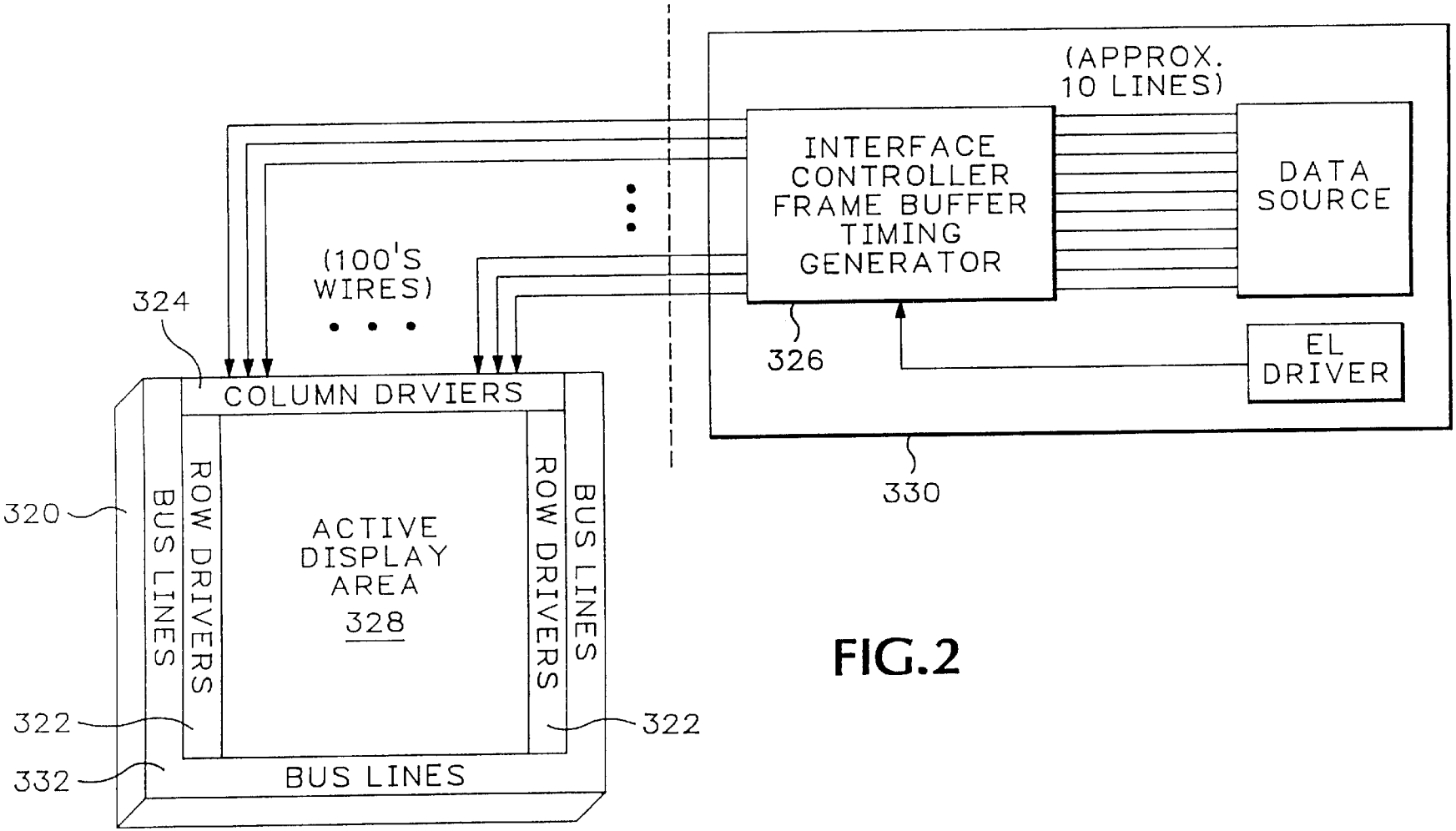
FIG. 2 is an electrical schematic of an active thin film electroluminescent device with row and column drivers adjacent the active display area.
Figure 3:
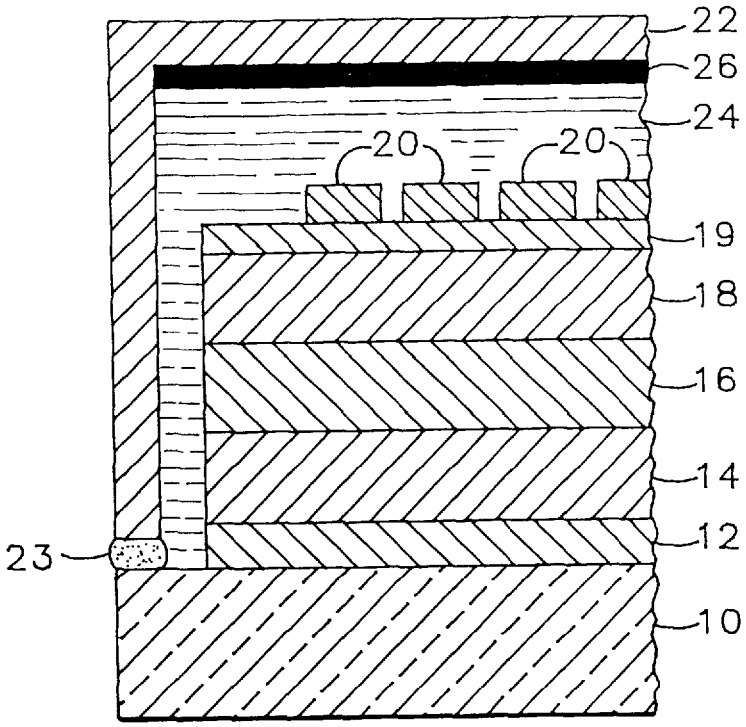
FIG. 3 is a partial cut away view of a passive TFEL device constructed according to the present invention.

Referring to FIG. 3, a passive thin film electroluminescent (TFEL) device includes a transparent substrate 10 typically made of glass, supporting a laminar stack comprising the TFEL elements. The laminar stack includes a set of transparent front electrodes 12 and a sandwich structure including the electroluminescent layer 16 sandwiched between front and rear dielectric layers 14 and 18, respectively. In an alternative embodiment, either dielectric layer 14 or 18 could be removed. A light absorption layer 19 may be situated behind the rear dielectric, such as that shown in U.S. patent application Ser. No. 08/208,732, assigned to the same assignee. Rear electrodes 20, typically made of aluminum, are disposed behind the rear dielectric 18 and extend in a direction perpendicular to the transparent front electrodes 12 so that pixel points of light are created when electrodes in both sets are energized simultaneously. The passive TFEL components are sealed against the substrate 10 by an enclosure 22 which may be affixed to the substrate 10 by any suitable adhesive 23. An optically absorbent material may be injected into the cavity defined by the enclosure 22 to further absorb light. This may take the form of silicon oil 24 which is conveniently used as a filler material for a solid filler of the type disclosed in U.S. Pat. No. 5,194,027. The silicon oil 24 may include a black dye to make it optically absorbent. The optical absorbtion is also enhanced by providing a black coating 26 on the rear inside cavity of the wall of the enclosure 22.

Figure 4:
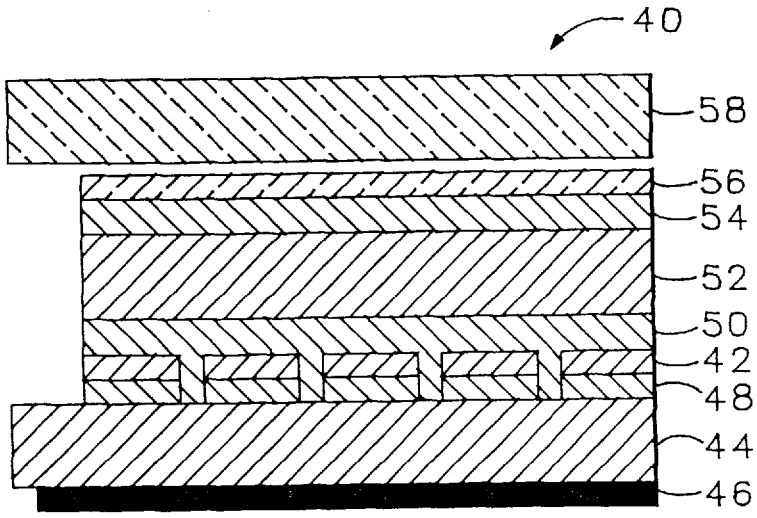
FIG. 4 is a partial cut away view of an alternative embodiment of a passive TFEL device constructed according to the present invention.

FIG. 4 shows an "inverted" structure electroluminescent device 40 that is similar to FIG. 3. The device 40 is constructed with a substrate 44 that preferably has a black coating 46 on the lower side if the substrate 44 is transparent. On the substrate 44 are deposited rear electrodes 48. Between the rear electrodes 48 and the rear dielectric layer 50 is a thin-film absorbtion layer 42. The absorbtion layer is either constructed of multiple graded thin-film layers or as a continuous graded thin-film layer using any appropriate method. An electroluminescent layer 52 is sandwiched between a rear dielectric layer 50 and a front dielectric layer 54. A transparent electrode layer 56 is formed on the front dielectric layer 54 and is enclosed by a transparent substrate 58 that is either bonded directly to the transparent electrode layer 56 or separated by a gap. The graduation of the absorbsion layer 42 is designed to absorb a substantial percentage of incident light thereon.

Figure 5:
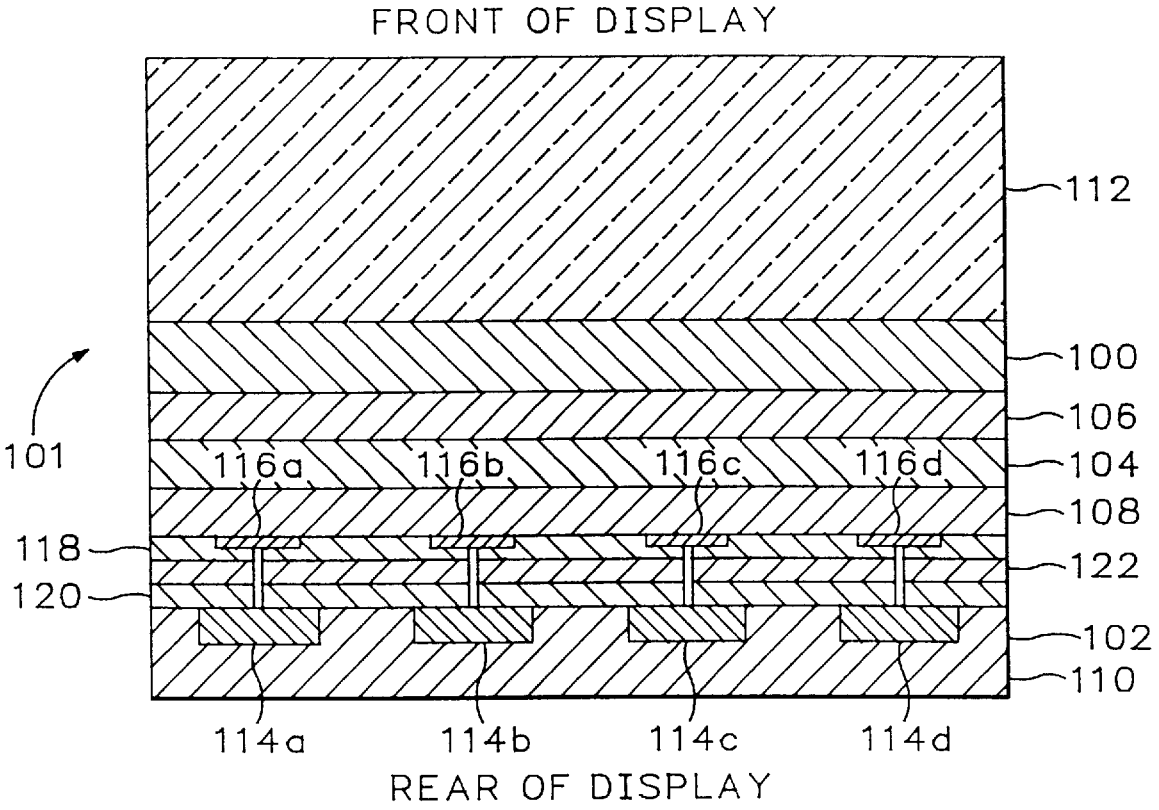
FIG. 5 is a cut away sectional representation of an inverted constructed AMEL device constructed in accordance with the present invention.

Referring to FIG. 5, an active matrix electroluminescent device (AMEL) 101 is constructed using an inverted structure. The structure includes a transparent electrode layer 100, a circuit layer 102, and at least three layers including an electroluminescent phosphor layer 104 sandwiched between front and rear dielectric layers 106 and 108, respectively. Alternatively, either the rear dielectric layer 108 or the front dielectric layer 106 may be omitted. The three layers are disposed between the circuit layer 102 and the transparent electrode layer 100. The circuit layer is deposited on a rearwardly disposed substrate 110. The rearwardly disposed substrate 110 is preferably high purity silicon in which the circuit layer 102 is fabricated. A front glass plate 112 is affixed on the transparent electrode layer 100. The individual circuit elements 114*a*, 114*b*, 114*c* and 114*d* are connected to respective pixel electrodes 116*a*, 116*b*, 116*c* and 116*d*, with a metal line connected through a hole commonly referred to as a via in auxiliary ground layers. The auxiliary ground layers comprise a first isolation layer 118, a second isolation layer 120, and a ground plane layer 122, preferably made of a highly conductive material such as aluminum or refractory metals. The isolation layers 118 and 120 are preferably made of glass. The grounding for the individual circuit elements 114*a*–114*d* is preferably the rearwardly disposed substrate layer 110 or the ground plane layer 122. The circuit elements 114*a*–114*d* may be those such as described in U.S. patent application Ser. No. 08/293,144, assigned to the same assignee, and incorporated by reference herein.

Figure 6:
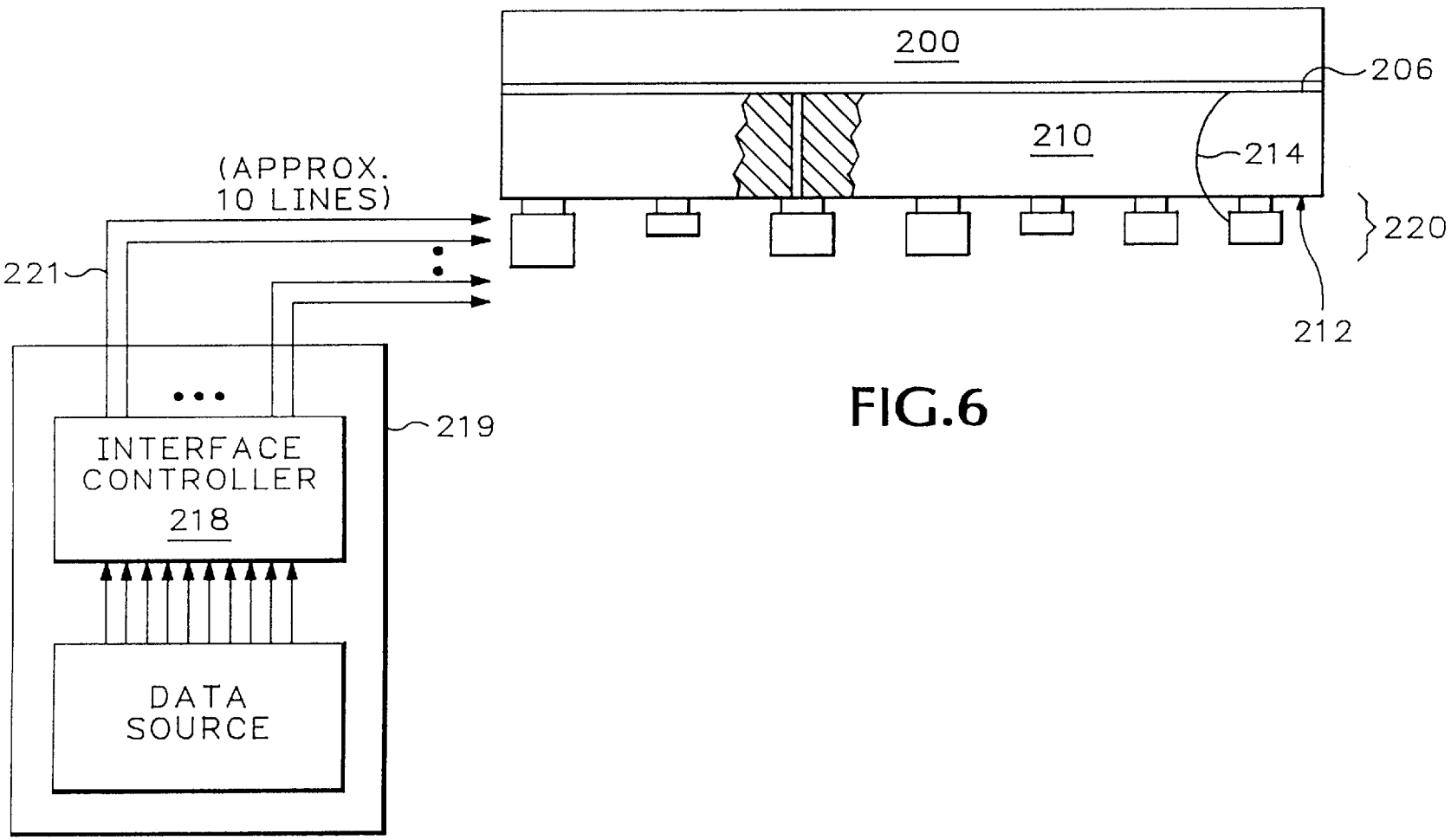
FIG. 6 is a partial cut away sectional view of an electroluminescent device with a rearwardly disposed substrate layer, interface layer and vias and/or wire wraps.

A substantial reduction in the number of wires or lines required to transmit signals between the display and the circuit board is realizable by relocating a portion of the interface controller and/or adding additional circuitry in a location proximate to the display. Referring to FIG. 6, a display 200, such as an AMEL display or a passive TFEL display, is affixed to the top 206 of a rearwardly disposed support layer 210, typically 20 mils thick, that is suitable for mounting and supporting the display 200 thereon. The display 200 is affixed and held in position on the support layer 210 with any suitable adhesive that creates a secure bond between the support layer 210 and the display 200.

Glass is commonly selected for the support layer 210 to reduce the cost of the display. Relocating a portion of the electronic components from the interface controller 218 (commonly located on a circuit board 219) or adding additional circuitry at a location proximate to the display 220 facilitates a reduction in the number of wires contained within an interconnect 221. Preferably, the electronics are affixed to the bottom side 212 of the support layer 210. Glass can support electronic components and traces thereon but it is difficult to work with. A different, presumably more expensive, material should be selected for the support layer 210 that is suitable for affixing electronic components to and depositing of metal traces on. The preferred support layer 210 is a multilayer ceramic, however, any material with high thermal conductivity is suitable, such as aluminum nitride (AlN) and diamond-like carbon material. In the preferred embodiment, the interface controller 218 includes traditional circuitry (described in detail later) and further includes a parallel-to-serial encoding circuit to transmit signals to the interface circuit 220, which in turn includes a serial-to-parallel decoding circuit to receive signals from the interface lines 221. This parallel-to-serial and serial-to-parallel connection reduces the number of lines required, but is generally at the expense of additional circuitry. Alternative encoding circuits and decoding circuits may be used to place the data in a format to be suitable for transmission on a limited number of signal lines. The interface circuit 220 may include such devices as control logic, and memory chips for the display 200. The interface circuit 220 and the interface controller 218 may be designed using alternative techniques for signal transmission to reduce the number of lines required between the interface controller 218 and the interface circuit 220.

Wrap-arounds, which are short metal traces that extend over the edge of the substrate 210, are each electrically connected between a respective one of a set of pads on the front 206 of the support layer 210 and the interface circuit 220. Alternatively vias 214, which are holes in the substrate coated or filled with metal, can be used to electrically interconnect each of the conductive pads on the front surface 206 with the interface circuit 220.

With the interface circuit 220 affixed directly to the support layer 210 the number of wires that must be routed to the interface controller 218 is reduced, thereby, increasing the reliability of the overall device. The weight of the total device and the routing problems associated with large interconnects is reduced by the substantial decrease in the number of wires, and hence the size of the interconnect. Furthermore, higher device reliability is achieved by the shorter connections, either with vias, wire wraps, or other suitable interconnection to the interface circuit 220. Additionally, safety is improved by eliminating the need for high voltage lines in the interconnect by locating the EL drive with the interface circuit, as will be more clearly illustrated with respect to FIG. 7.

Figure 7:
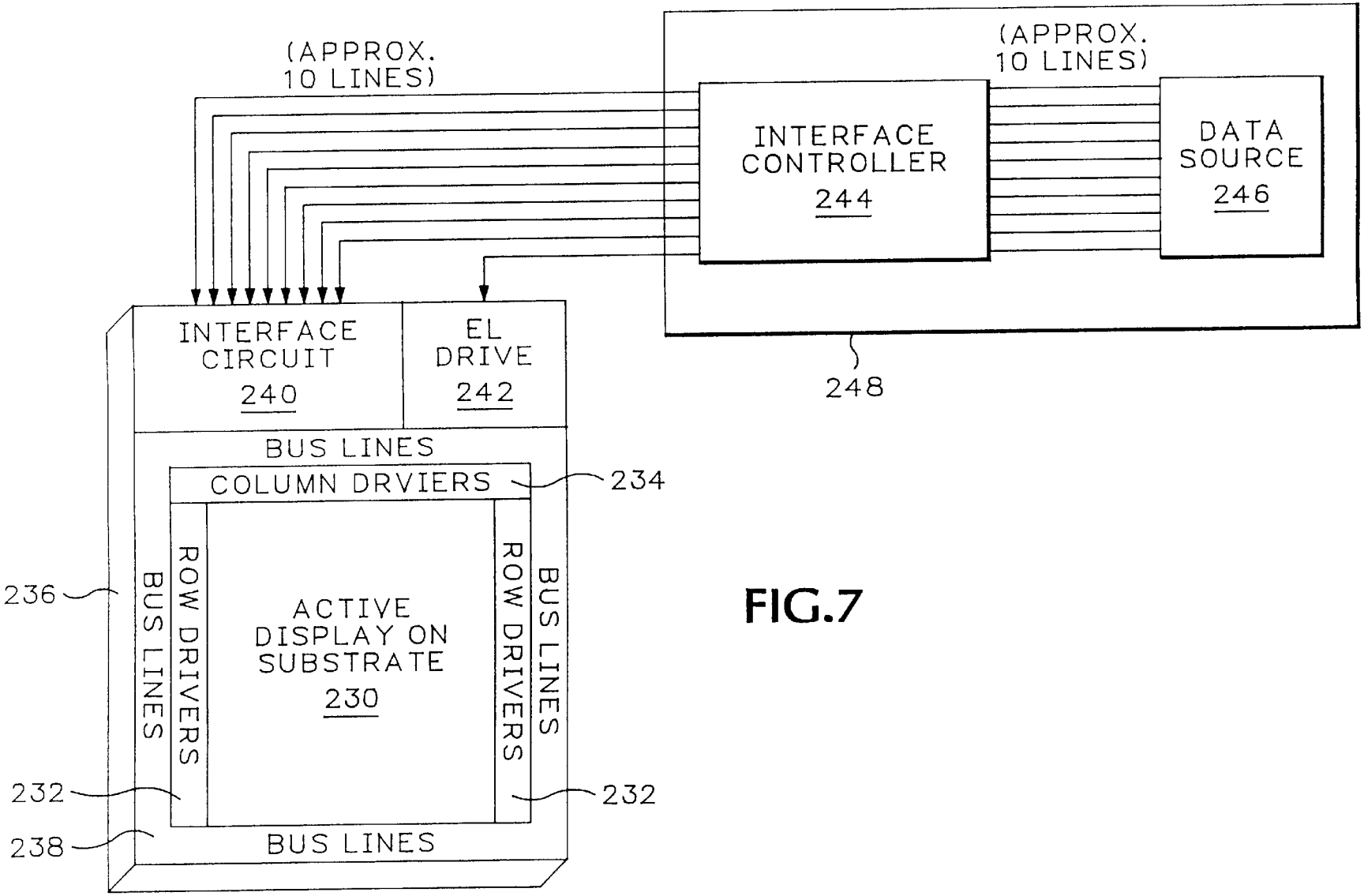
FIG. 7 is an electrical schematic of an active thin film electroluminescent device constructed according to the present invention.

Referring to FIG. 7, an alternative arrangement for an AMEL device is shown. The display 230, including column drivers 234 and row drivers 232 is fabricated on a rearwardly disposed substrate layer, which is preferably silicon. The rearwardly disposed substrate layer is affixed to a support layer 236 that is larger than the combined display 230, row driver 232 and column driver 234. By selecting a supporting layer 236 that is suitable for depositing metal traces thereon, as previously described, the bus lines 238 can be located on the relatively inexpensive support layer 236, as compared to a silicon substrate. Additionally, the bus lines 238 can be located more economically a further distance from the display area because the support layer 236 is relatively inexpensive. This reduces the electromagnetic interference effects of the high voltage and the high frequency signals in the bus lines 238 on the display. The placement of bus lines 238 on a support layer 236 economically allows the use of a wider choice of more conductive metals, such as copper and gold, and those lines may be economically fabricated wider and thicker allowing for even greater conductivity than previously achievable with AMEL displays. Further, the coupling between bus lines 238 is reduced by spacing them further apart on the inexpensive support layer 236. The interface circuit 240 is relocated to the front of the support layer 236. The EL drive 242 is also preferably relocated to the front or back of the support layer 236 to eliminate the need for high voltage signals in any of the interconnect lines between the circuit board 248 and display which improves safety. The interface circuit 240 and EL drive 242 are electrically connected to the interface controller 244 which is in turn electrically connected to the data source 246. A passive TFEL device may also be constructed in a manner similar to that shown in FIG. 7 for an AMEL device.

Figure 8:
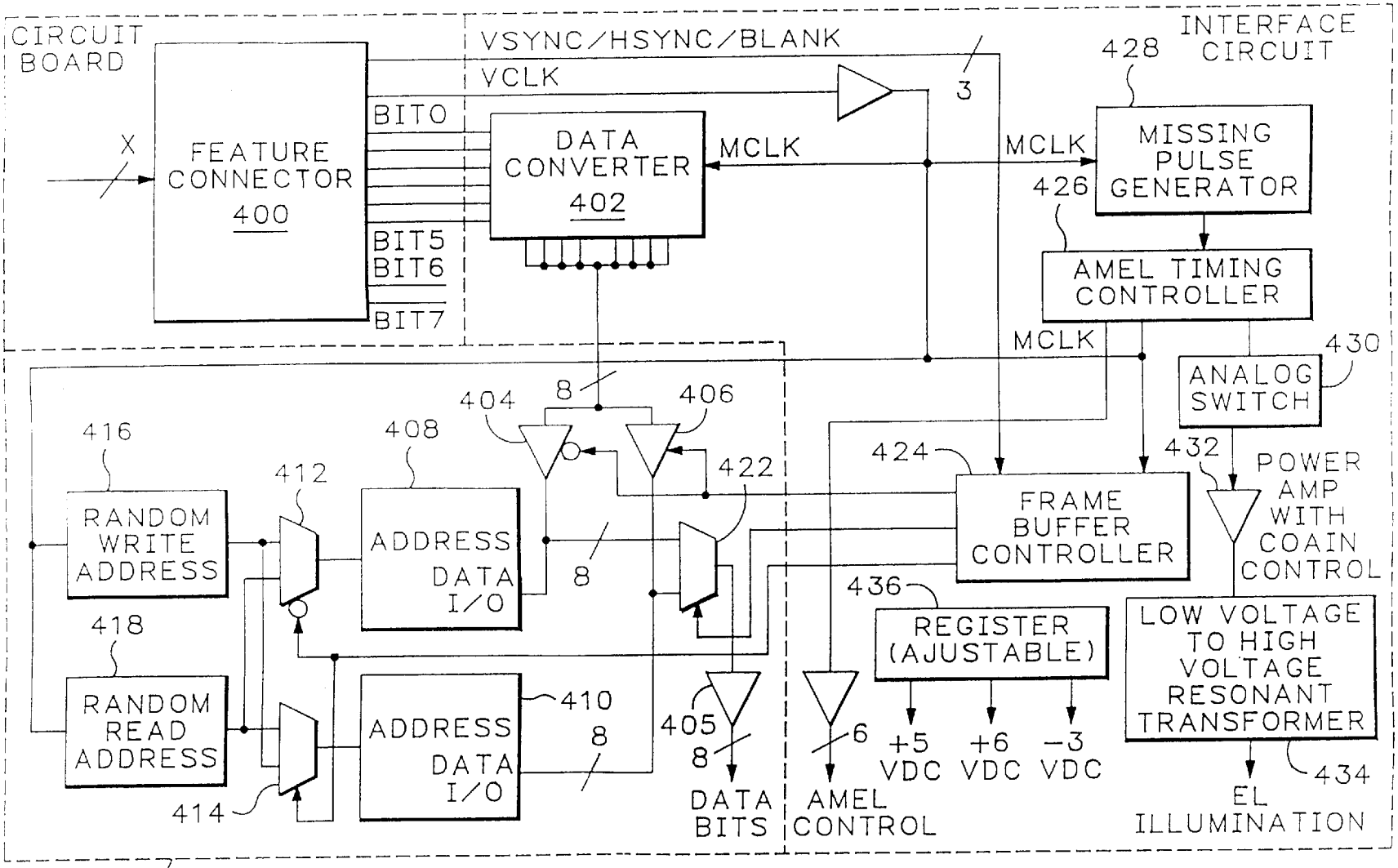
FIG. 8 is a block diagram of an interface circuit and circuit board.

Referring to FIG. 8, a block diagram of one design suitable for a 640×480 line display is shown. The feature connector 400 on the circuit board transmits unencoded digital data, such as that from a standard VGA chip set commonly found on a VGA card, from the circuit board to the interface circuit. The data transmitted from the feature connector 400 typically includes a parallel set of digital image data (8 bits), a clock signal, and three synchronization signals for a total of 12 lines. The data converter 402 receives the parallel image data and each individual bit is reformatted and transmitted as a byte wide word (the two least significant bits are not used). For example, eight sets of parallel data 100101, 100101, 100101, 100101, 100101, 100101, 100101, 100101, received by the data converter 402 would be converted and transmitted as 11111111, 00000000, 00000000, 11111111, 00000000, and 11111111. A frame buffer 420 includes two static ram memories 408 and 410, multiplexers 412, 414, and 422, random write address block 416, contiguous read address block 418, a pair of tri-state buffers 404 and 406 connected to the output of the data converter 402, and a tri-state buffer 405 connected to the output of the frame buffer 420. The frame buffer 420 permits writing data to one memory chip while reading data from the other memory chip, and vice versa. The frame buffer controller 424 mainly controls the operation of the frame buffer 420. The AMEL timing controller 426 provides both AMEL control signals and a signal to control the frame buffer controller 424. The missing pulse detector 428 is a safety device that checks to see if an input clock from the feature connector 400 is being transmitted. If no input clock is being transmitted then it disables a sine wave generator signal within the AMEL timing controller. The sine wave generator within the AMEL timing controller 426 is transmitted to an analog switch 430, amplified by a power amplifier 432, and then stepped up to a high voltage by a low-voltage to high-voltage step up resonant transformer 434. The transformer 434 provides the EL illumination drive signal. The interface circuit also provides three adjustable voltages from block 436, namely, +5 volts DC, +6 volts DC, and −3 volts DC. The input to the interface circuit, as shown in FIG. 8, requires ten lines (6 bits of data, Vsync, Hsync, Blank). The output of the interface circuit to the display has 31 lines (8 data bits, 6 AMEL control, EL Illumination, EL Illumination return (not shown), +5 volts, +7 volts, −3 volts, 8 data ground returns (not shown), PCLK return (not shown), MIC+ (not shown), MIC (not shown), VBIAS (not shown). Accordingly, if the interface circuit was remote from the display 31 lines one wire bundle interconnect routed to the display would be required. However, by locating the interface with the display only at most 12 lines would be required which requires a substantially reduced size of the wire bundle interconnect.

If a display with a greater number of lines and columns is used, such as a 2560×2048 display then the reduction in the number of lines is greater. Such a display has about 12 input lines from the image source to the interface circuit. The display requires about 192 signal lines to operate so a reduction of about 180 lines is realized, depending on the actual design used. A wire bundle for 192 lines would typically require about a 0.750" diameter bundle which is heavy, large, bulky, rigid and expensive. Furthermore, if an additional parallel-to-serial circuit is included on the circuit board and an associated serial-to-parallel circuit is included on the interface circuit then the number of data lines required from the image source to the interface circuit can be reduced to possibly several lines, thereby realizing a substantial reduction in the number of lines.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A thin film electroluminescent device including a plurality of layers including at least a transparent electrode layer, a circuit layer, and at least two layers including an electroluminescent layer and a dielectric layer, said at least two layers disposed between said circuit layer and said transparent electrode layer so as to emit light upon the application of an electric field comprising:

(a) said plurality of layers supported by a rearwardly disposed support layer directly connected to said circuit layer, where said circuit layer is further distant from said emitted light as said emitted light exits said device than said transparent electrode layer;

(b) an interface circuit supported by and directly connected to said support layer;

(c) said support layer rigidly interconnects said circuit layer and said interface circuit such that both said interface circuit and drivers cannot freely move with respect to said circuit layer;

(d) said interface circuit electrically interconnected with said drivers by a plurality of first electrical lines;

(e) said drivers electrically interconnected with said plurality of layers by a plurality of third electrical lines separate from said plurality of said first electrical lines so as to enable pixels within said electroluminescent device to be selected;

(f) an interface controller remotely located from said support layer and electrically interconnected with said interface circuit by at least one second electrical line so as to indicate which pixels within said device to illuminate; and (g) the number of first electrical lines is greater than the number of said at least one second electrical line.

2. The thin film electroluminescent device of claim 1, wherein the number of first electrical lines is substantially greater than the number of said at least one second electrical line.

3. The thin film electroluminescent device of claim 1 wherein said plurality of layers is supported by a first side of said support layer, said interface circuit is supported by a second side of said support layer, and wire wraps electrically connect said interface circuit to said plurality of layers.

4. The thin film electroluminescent device of claim 1, wherein said plurality of layers is supported by a first side of said support layer, said interface circuit is supported by a second side of said support layer, and a plurality of vias in said support layer electrically connect said interface circuit to said plurality of layers.

5. The thin film electroluminescent device of claim 1, wherein said interface circuit includes an electroluminescent driver, said electroluminescent driver generates a high voltage signal in response to receiving a low voltage signal, and said high voltage signal energizes said transparent electrode layer.

6. The thin film electroluminescent device of claim 1, wherein said drivers are row drivers and column drivers to energize selected pixel electrodes within said plurality of layers.

7. The thin film electroluminescent of claim 1 wherein both said plurality of layers and said interface circuit are supported on the same side of said support layer.

8. The thin film electroluminescent device of claim 1, wherein said support layer has high thermal conductivity.

9. The thin film electroluminescent device of claim 1, wherein said support layer is a dielectric.

10. A thin film electroluminescent device includes a plurality of layers including at least a front electrode layer, a rear electrode layer, and at least two layers including an electroluminescent layer and a dielectric layer, said at least two layers disposed between said rear electrode layer and said front electrode layer so as to emit light upon the application of an electric field comprising:

(a) said plurality of layers supported by a rearwardly disposed support layer directly connected to said rear electrode layer, where said rear electrode layer is further distant from said emitted light as said emitted light exits said device than said front electrode layer;

(b) an interface circuit supported by and directly connected to said support layer;

(c) said support layer rigidly interconnects said rear electrode layer and said interface circuit such that both said interface circuit and drivers cannot freely move with respect to said rear electrode layer;

(d) a plurality of first electrical lines electrically interconnecting said interface circuit to said drivers, said drivers electrically interconnected with said plurality of layers by a plurality of third electrical lines separate from said plurality of said first electrical lines so as to enable said front electrodes and selected said rear electrodes to be energized;

(e) an interface controller remotely located from said support layer and electrically interconnected with said interface circuit by at least one second electrical line so as to indicate which pixels within said device to illuminate; and (f) the number of first electrical lines is greater than the number of said at least one second electrical line.

11. The thin film electroluminescent device of claim 10, wherein the number of first electrical lines is substantially greater than the number of said at least one second electrical line.

12. The thin film electroluminescent device of claim 10, wherein said plurality of layers is supported by a first side of said support layer, said interface circuit is supported by a second side of said support layer, and wire wraps electrically connect said interface circuit to said plurality of layers.

13. The thin film electroluminescent device of claim 10, wherein said plurality of layers is supported by a first side of said support layer, said interface circuit is supported by a second side of said support layer, and a plurality of vias in said support layer electrically connect said interface circuit to said plurality of layers.

14. The thin film electroluminescent device of claim 10, wherein said interface circuit includes an electroluminescent driver, said electroluminescent driver generates a high voltage signal in response to receiving a low voltage signal, and said high voltage signal energizes said selected rear electrodes.

15. The thin film electroluminescent device of claim 10, wherein said interface circuit includes row drivers and column drivers to energize respective row electrodes and column electrodes within said plurality of layers.

16. The thin film electroluminescent of claim 10 wherein both said plurality of layers and said interface circuit are supported on the same side of said support layer.

17. The thin film electroluminescent device of claim 10, wherein said support layer is a dielectric.

18. The thin film electroluminescent device of claim 10, wherein said support layer has high thermal conductivity.

* * * * *

UNITED STATES PATENT AND TRADEMARK OFFICE

CERTIFICATE OF CORRECTION

PATENT NO. : 5,877,735
DATED : March 2, 1999
INVENTOR(S) : Christopher N. King et al.

It is certified that error appears in the above-identified patent and that said Letters Patent is hereby corrected as shown below:

Column 3,
Line 8, delete "be" after "could"

Column 4,
Line 57, delete "absorbtion" and insert -- absorption --
Line 66, delete "absorbsion" and insert -- absorption --

Column 7,
Line 39, missing end parenthesis; "... VBIAS (not shown"; insert -- ) -- after shown Column 8,
Line 59, between "electroluminescent" and "of claim"; insert -- device --

Column 10,
Line 24, between "electroluminescent" and "of claim"; insert -- device --

Signed and Sealed this

Nineteenth Day of March, 2002

*Attest:*

*Attesting Officer*

JAMES E. ROGAN
*Director of the United States Patent and Trademark Office*